United States Patent [19]

Eheim

[11] 4,059,369

[45] Nov. 22, 1977

[54] FUEL INJECTION PUMP

[75] Inventor: Franz Eheim, Stuttgart, Germany

[73] Assignee: Robert Bosch G.m.b.H., Stuttgart, Germany

[21] Appl. No.: 652,873

[22] Filed: Jan. 27, 1976

[30] Foreign Application Priority Data

Jan. 28, 1975. Germany ..... 2503300

[51] Int. Cl.[2] ..... F04B 7/06

[52] U.S. Cl. ..... 417/494; 123/139 BD; 123/139 E

[58] Field of Search .... 123/139 R, 139 BD, 139 AA, 123/139 E, 139 AD; 417/493, 494

[56] References Cited

U.S. PATENT DOCUMENTS

| | | | |
|---|---|---|---|
| 2,260,414 | 10/1941 | Thaheld | 417/493 X |
| 2,544,561 | 3/1951 | Meyer | 123/139 BD UX |
| 2,965,087 | 12/1960 | Bischoff et al. | 123/139 BD UX |
| 3,762,379 | 10/1973 | Hobo et al. | 123/139 E X |
| 3,896,779 | 7/1975 | Omori et al. | 123/139 E |
| 3,908,619 | 9/1975 | Bittelmeyer | 123/139 BD |

*Primary Examiner*—Carlton R. Croyle
*Assistant Examiner*—Michael Koczo, Jr.
*Attorney, Agent, or Firm*—Edwin E. Greigg

[57] ABSTRACT

A fuel injection pump for internal combustion engines has a single rotatig and reciprocating piston which alternately aspirates fuel from a fuel storage compartment and delivers it under pressure to one of several injection lines. Fuel aspiration takes place through a plurality of fuel channels which terminate in the wall of the pump cylinder and whose termini are opened by appropriate grooves in the piston surface. The individual fuel channels are in mutual communication via one or more connection channels and are also connected to the fuel storage compartment via a suction conduit.

5 Claims, 6 Drawing Figures

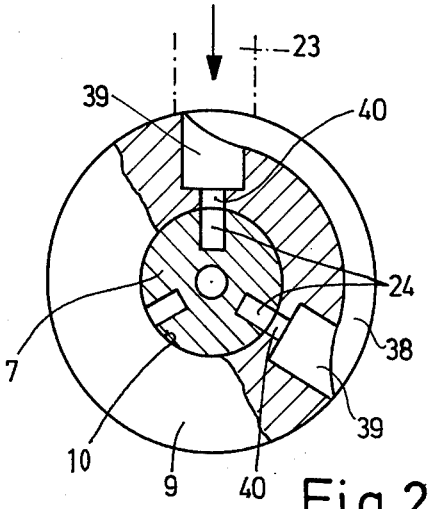
Fig.2
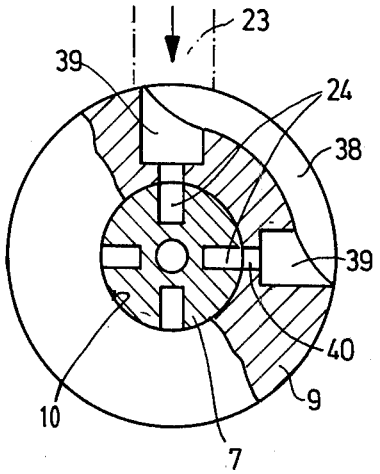
Fig.3
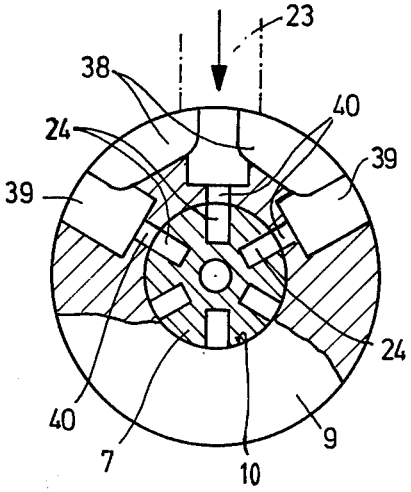
Fig.4
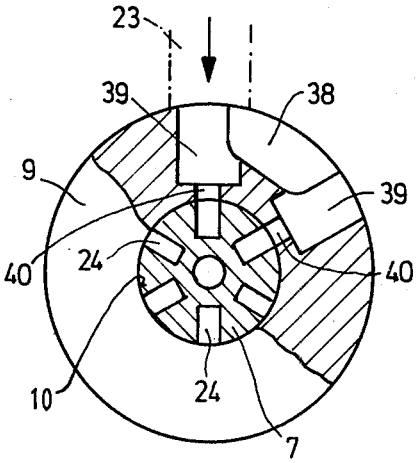
Fig.5
Fig.6
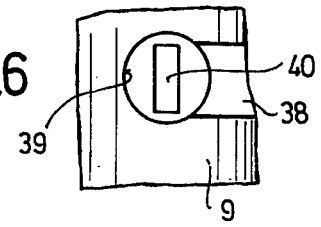

FUEL INJECTION PUMP

BACKGROUND OF THE INVENTION

The invention relates to a fuel injection pump for internal combustion engines having a rotating distribution piston which, acting within a cylinder, periodically connects the pump's working or pressure chamber during the suction stroke through radial apertures in its circumference with several fuel channels in the cylinder wall, at a rate dependent upon its rotational speed.

It is well known that any "harmful space" or "deadspace" in a pump pressure chamber i.e., the volume remaining in the pressure chamber at the top dead center of the pump piston becomes especially detrimental to the proper control of the fuel quantity to be injected, whenever the dead space is relatively large with regard to the injected fuel quantity. Consequently, the dead space is especially detrimental at low engine revolutions. Particularly at low engine revolutions, however, it is required that only minor variations in the metered fuel quantity occur, in order to achieve a quiet running of the engine on the one hand, and a favorable composition of the exhaust gases on the other hand. Where pumps are regulated by suction throttle, the effect is due to the fluid volume between the suction throttle and the pump pressure chamber.

In the injection pumps of today's generally fastturning diesel engines, it is essential, due to the high revolutions, that the cross-sectional opening between the suction line and the pump pressure chamber be large, so as to obtain an effective cross-sectional opening at high revolutions, of sufficient duration to fill the pump working chamber during the suction stroke. For this very reason, a well-known fuel injection pump design incorporates, respectively, twice as many radial apertures in its pump piston as the number of engine cylinders supplied with fuel by the injection pump. In each instance, two bores, arranged axially, one above the other in the pump piston, together work in conjunction with a longitudinal groove in the cylinder bushing of the injection pump. However, these longitudinal grooves lead directly and independently into the fuel suction chamber of the injection pump, resulting in an admittedly very favorable effective cross-sectional opening, but rendering it impossible to influence any part of the suction fuel flow by any simple means.

OBJECT AND SUMMARY OF THE INVENTION

It is a principal object of the present invention to provide a fuel injection pump of the above-described type which attains a large effective cross-sectional opening between radial piston apertures and the fuel suction channels, during the suction stroke, and in which, moreover, the cross-section that is not affected by the rotation of the distribution piston may be varied by relatively simple means.

The present invention achieves this object by the use of a connecting channel, which connects the suction fuel channels with a common and controllable suction conduit. Thus it is possible to control, by very simple means, the fuel quantity flowing to the pressure chamber of the pump, whether the pump be of the so-called suction throttle-regulated type, or of a type employing a compression-stroke control.

Primarily in order to minimize the harmful dead space between the control point in the suction conduit and the working chamber of the pump, but also in order to minimize the machining operations at the control points between pump piston and cylinder, one embodiment of the invention includes fuel channels which are fewer in number than the number of radial piston apertures. In addition, the connecting channel is formed in an arc of minimum length, resulting in an advantageous rectangular control cross-section of the suction channel at its orifice in the cylinder, corresponding to the similar cross-section of the radial piston apertures embodied as longitudinal grooves. Since the distribution pump employs a rotational control process, a rectangular cross-section for the overlapping control openings is the most advantageous in the quest to maximize the effective cross-sectional openings as a function of opening time.

The invention will be better understood as well as further objects and advantages thereof will become more apparent from the following detailed description of four preferred embodiments taken in conjunction with with drawing .

BRIEF DESCRIPTION OF THE DRAWING

FIGS. 2, 3, 4, and 5 illustrate four different embodiments of the connecting channels between the suction fuel channels, and include a magnified cross-section through the pump cylinder along the line II—II in FIG, 1; and FIG. 6 is a view toward the cylinder and one of the suction fuel channels.

DESCRIPTION OF THE PREFERRED EMBODIMENT

Figure 1:
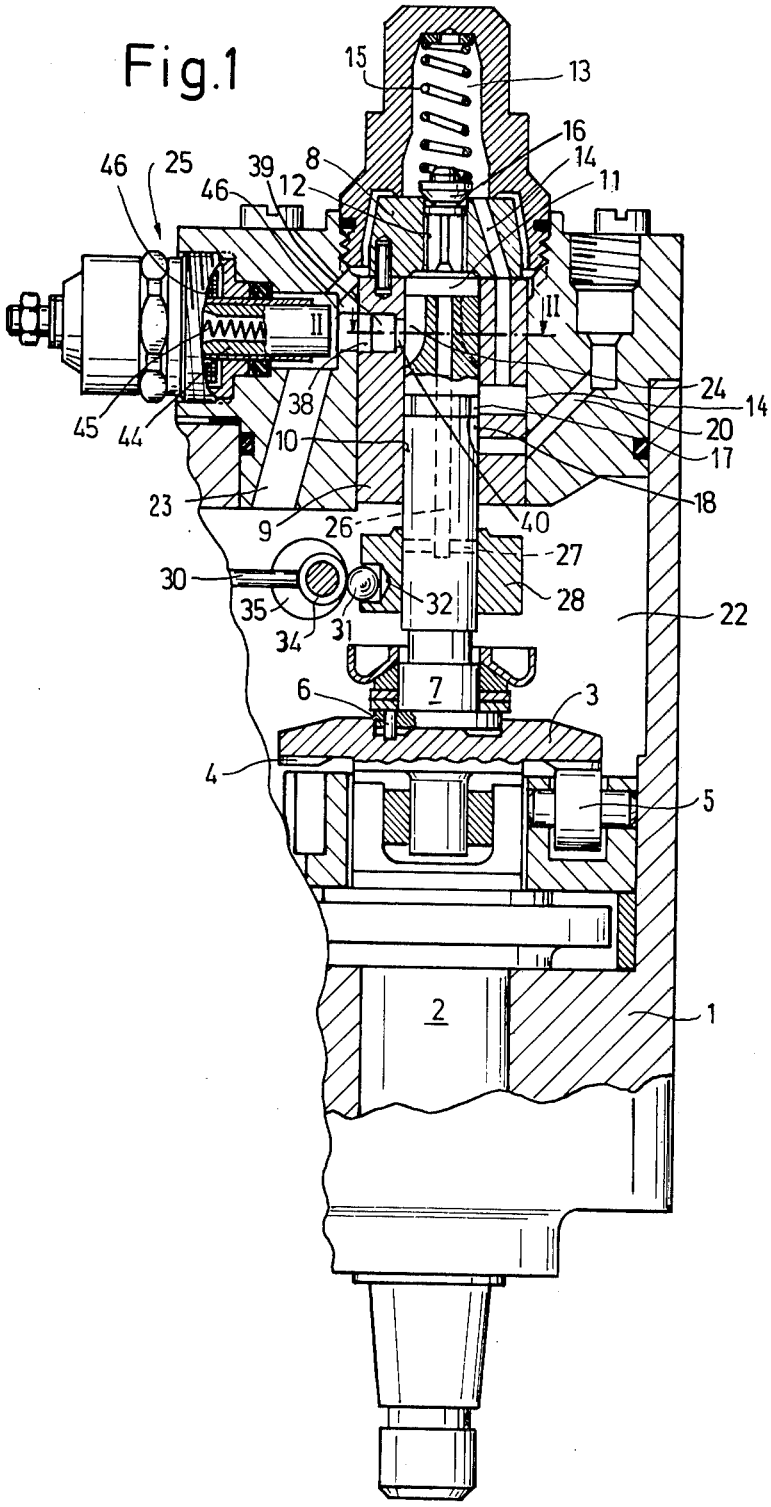
FIG. 1 is a partial, longitudinal, sectional view of the pump according to the present invention.

Turning now to FIG. 1, there is shown a fuel injection pump for multi-cylinder, internal combustion engines including a housing 1 in which is rotatably carried a drive shaft 2. Co-rotating with the drive shaft 2 is a frontal cam plate 3 provided with a plurality of cam lobes 4 which cooperate with locally-fixed rollers 5. The rotation of the drive shaft 2 due to means not shown causes rotation of the frontal cam plate 3 which is transmitted by a coupling member 6 to a pump piston 7 which is thereby made to undergo simultaneous reciprocating and rotating motion while being pressed on the cam plate 3 by spring means not shown. The number of cam lobes 4 and hence the number of piston strokes per revolution is equal to the number of cylinders in the engine.

The piston 7 moves in a bore 10 within a cylindrical bushing 9 closed on top by a valve carrier 8, thereby defining a working pressure chamber 11. An axial bore 12 in the valve carrier 8 connects the pressure chamber 11 with a blind chamber 13 which is connected by a line 14 to the cylindrical bore 10 in the bushing 9. The axial bore 12 may be obturated by a valve member 16 loaded by a spring 15. The connecting line 14 terminates radially into the cylindrical bore 10, and an annular groove 17 located on the circumference of the pump piston and a longitudinal groove 18 connected thereto create a communication between the terminus of the connecting line 14 and sequential ones of the individual pressure lines 20 during each compression stroke of the piston. The pressure lines 20 lead to individual engine cylinders (not shown) and are equal in number to the number of engine cylinders.

During each compression stroke of the piston 7, fuel is delivered through the axial bore 12, which opens the valve member 16, and hence into the chamber 13, the connecting line 14 and through the distribution groove 18 to one of the pressure supply lines 20. During the downward, suction stroke of the piston, fuel flows from a slightly pressurized pump suction chamber 22 through a suction line 23 into the bore 10. The fuel flow from the suction chamber is controlled by a number of longitudinal grooves 24 on the pump piston, equal in number to the number of pressure lines 20. During the compression stroke of the piston, the rotation of the piston interrupts the communication between the suction line 23 and the longitudinal grooves 24 so that the entire fuel quantity supplied by the piston is delivered to one of the pressure lines 20. The suction conduit 23 is further controllable by an electromagnetic valve 25, as will be explained in detail below.

The amount of fuel delivered to the engine is controlled by changing the fuel flow from the pressure chamber 11 to the suction chamber 22 through a blind bore 26 in the pump piston 7 which connects with a transverse bore 27. Cooperating with the transverse bore 27 is a fuel quantity setting member 28, embodied as an annular slide displaceable on the outside surface of the pump piston, whose position determines the point of time at which the trasnverse bore 27 is opened when the pump piston moves upwardly, thus creating a communication between the pressure chamber 11 and the pump suction chamber 22. From this point on, the supply of fuel to the pressure line 20 is interrupted. By changing the position of the annular slide 28, the fuel quantity actually delivered to the engine may thus be adjusted.

The adjustment of the fuel quantity is performed by the engagement of a ball head 31 of a control lever 30 engaging a recess 32 in the annular slide 28. The control lever pivots about a point 34 whose position can be changed by an eccentric 35. The other end of the control lever 30 is engaged by a control spring (not shown) in opposition to the force of an r.p.m. signal generator, also not shown. The bias tension of the control spring may be adjusted with an arbitrarily settable lever, also not shown. When the engine r.p.m. increases, the r.p.m. signal generator acts to reduce the injected fuel quantity, whereas the spring urges the lever in the direction of increasing fuel quantity. The equilibrium position, which defines the actual injected fuel quantity, can be adjusted by the abovementioned lever.

In FIGS. 2 to 6, the cylinder bushing 9 and the pump piston 7 are shown in a magnified scale, whereof FIGS. 2 to 5 are cross-sections, and FIG. 6 is a partial sectional plan view.

As seen in FIGS. 2 to 5, supply line 23 serving as a suction line opens into the arc-shaped groove 38, lying on the skirt of cylinder sleeve 9 and creating a connection passage to several suction fuel channels 39 radially disposed in the cylinder bushing 9. The suction fuel channels 39 connect with the cylinder bore 10 of the cylinder bushing 9 via openings 40, which possess, as shown in FIG. 6, a rectangular cross-section. These openings 40 cooperate with the longitudinal grooves 24, and the intersection of their rectangular cross-sections results, first, in a very precise control, and second, in a maximized effective cross-sectional opening as a function of time.

As shown by FIGS. 2 to 5, during the suction stroke of the pump, (variously illustrated), each of at least two of the suction fuel channels 39 always communicates with some corresponding longitudinal groove 24, and thus with the pump pressure chamber 11. According to the example of FIG. 4, three openings 40 are, in fact, in communication with the fuel channels 39 via the longitudinal grooves 24 during the suction stroke. The actual number of such simultaneous communicating connections is, essentially, dependent upon whether the cylinder pump, possessing respectively 3, 4, or 6 longitudinal grooves 24, supplies either 3, 4, or 6 engine cylinders. Herein the distance, in the directon of rotation, between one opening 40 and a subsequent one, which is determined by the longitudinal grooves 24, is kept as small as possible, so that, within the sequence, the nearest or the nearest and next-nearest fuel channel 39 shall always be interconnected via a connecting channel 38. By these means, both a maximum effecive time cross-section and a minimum of harmful space are obtained between the point in the suction line 23 controlled by the electromagnetic valve 25, and the control point between the longitudinal grooves 24 and the openings 40.

The suction line 23 is blocked by the electromagnetic valve 25 as soon as the electric current is halted. This event occurs, for example, whenever the ignition of the vehicle is turned off. In this event, the movable valve member 44, which also serves as the armature of the electromagnetic valve, is held against the fixed valve seat 46 by a spring 45. Whenever the ignition of the vehicle is again turned on, the elctromagnetic coil 46 is activated, once again pulling the armature 44 in opposition to the force of the closing spring 45 into the opened position of the valve.

What is claimed is

1. In a fuel injection pump for internal combustion engines which includes a housing, a fuel storage compartment in said housing, cylinder means disposed in said housing and a reciprocating and rotating piston moving in said cylinder means and defining a pressure chamber, a plurality of fuel channels in said housing, one terminus of each of said plurality of fuel channels lying in the wall of said cylinder, said piston having radial apertures which cooperate with said termini to thereby provide rpm-dependent flow control through said plurality of fuel channels, the improvement comprising at least one connection channel in the cylinder means connected to said plurality to fuel channels for providing mutual fluid communication between at least two of said plurality of fuel channels, and a suction conduit connected between said mutually communicating fuel channels and said fuel storage compartment.

2. A fuel injection pump as defined by claim 1, wherein the number of said fuel channels is smaller than the number of said radial apertures in said piston and wherein said connection channel is a partial annular channel of minimum feasible length.

3. A fuel injection pump as defined by claim 1, the improvement further comprising electromagnetic valve means disposed in said housing for controlling the fluid flow through said suction conduit.

4. A fuel injection pump as defined by claim 1, wherein said termini have a rectangular transverse cross section and wherein said radial apertures in said piston are longitudinal grooves which have a rectangular cross section complementary to the cross section of said termini.

5. A fuel injection pump as defined by claim 1, wherein said plurality of fuel channels consists of at most three fuel channels.

* * * * *